United States Patent [19]

Agee et al.

[11] Patent Number: 4,564,180

[45] Date of Patent: Jan. 14, 1986

[54] HAND HOLDING APPARATUS FOR HAND SURGERY

[75] Inventors: John M. Agee, 3980 Bartley Dr., Sacramento, Calif. 95822; Francis C. King, Shingle Springs, Calif.

[73] Assignee: John M. Agee, Sacramento, Calif.

[21] Appl. No.: 552,185

[22] Filed: Nov. 15, 1983

[51] Int. Cl.[4] ..... A61G 13/00

[52] U.S. Cl. ..... 269/75; 269/328

[58] Field of Search ..... 269/328, 75; 5/431

[56] References Cited

U.S. PATENT DOCUMENTS

| | | | |
|---|---|---|---|
| 269,708 | 12/1882 | Read | 269/75 |
| 3,540,719 | 11/1970 | Romney | 269/328 |
| 3,746,332 | 7/1973 | Hakstian | 269/328 |

*Primary Examiner*—Robert C. Watson

*Attorney, Agent, or Firm*—Townsend and Townsend

[57] ABSTRACT

Apparatus for supporting a patient's hand for surgery, the apparatus including a base plate for placement on an operating table, and an upper plate above the base plate and pivotally coupled thereto by an adjustable ball and socket assembly. The upper plate can be pivoted into any one of a number of operative positions, and the ball and socket assembly can be adjusted to releasably hold the upper plate in a fixed position. A pair of surface defining devices are located near one end edge of the upper plate, one of the devices having a flat upper surface coextensive with the upper surface of the plate, the other device being hingedly mounted to the first device to provide a flat surface coextensive with the upper surface of the plate when the second device is in an outwardly extending position with respect to the first device. The second device can move into a position overlying the first device to present a convex upper surface on the second device for supporting the fingers of the hand when the dorsal surfaces of the hand and wrist are to be exposed. The parts of the apparatus are made of metal to permit them to be steam autoclaved for sterility.

10 Claims, 4 Drawing Figures

FIG. 1
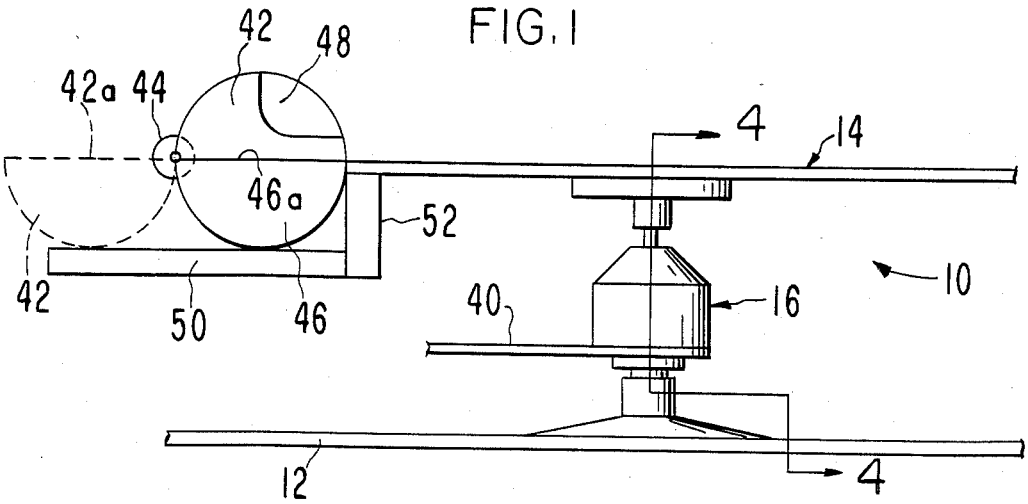
FIG. 2
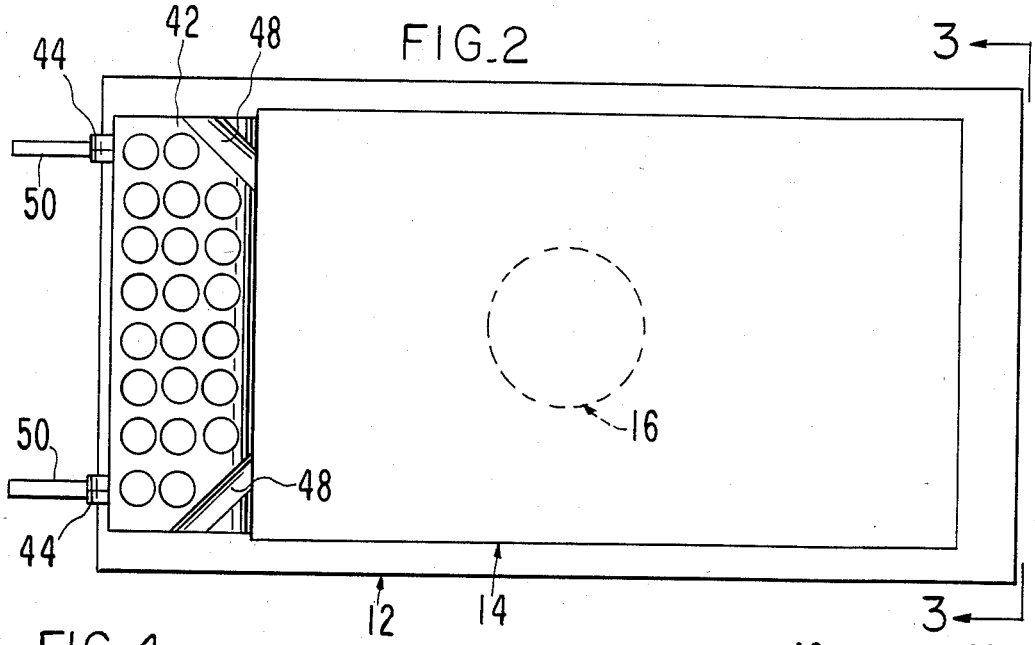
FIG. 4
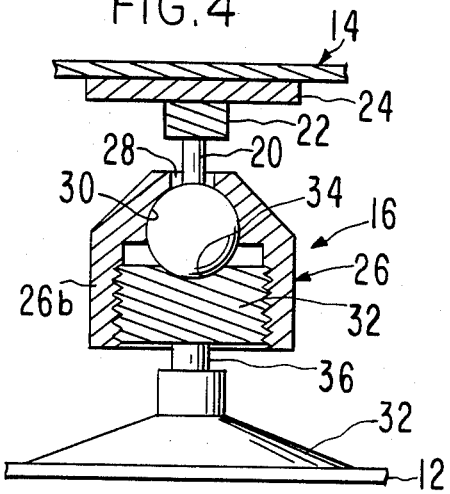
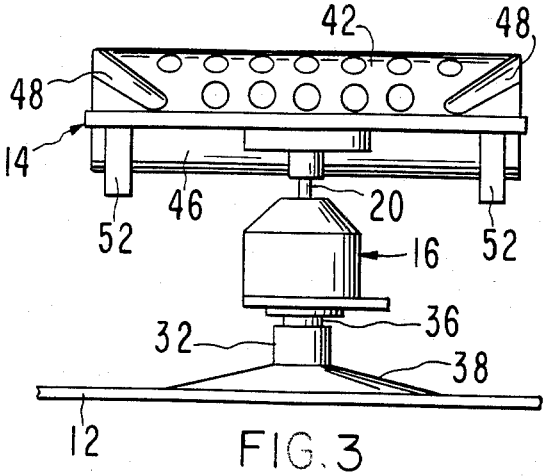
FIG. 3

HAND HOLDING APPARATUS FOR HAND SURGERY

This invention relates to improvements in accessories for use during surgical operations and, more particularly, to apparatus for holding and supporting the hand of a patient in any one of a number of operative positions for surgical purposes.

BACKGROUND OF THE INVENTION

In performing surgery on a patient's hand or wrist, it is vitally important in many cases to orient the hand and wrist to facilitate the surgery. Attempts have been made in the past to provide devices for this purpose; however, all such attempts have resulted in structures which are complex in construction, difficult to manipulate, and bulky in size and shape. A need, therefore, has existed for an improved apparatus for holding and supporting the hand and wrist of a patient, so as to expose either the palmar surface or the dorsal surface or either border of the hand quickly and easily while providing a sturdy support for the extremity.

SUMMARY OF THE INVENTION

The present invention satisfies the aforesaid need by providing an improved apparatus for holding and supporting a patient's hand and wrist in a desired orientation for surgery. The apparatus has a relatively few number of parts; it is simple and rugged in construction; and it can be used readily when operating on the palmer surface or the dorsal surface of the hand and/or wrist. Moreover, the apparatus of the present invention can be steam autoclaved for sterility and is small enough and compact in size and shape so as to be readily stored when not in use. The apparatus is inexpensive to produce and there is substantially no maintenance even though it has several moving parts which can be made of high quality material to provide a long, useful operating life for the apparatus.

The primary object of the present invention is to provide an improved hand holding and supporting apparatus device for surgical purposes wherein the device is simple and rugged in construction, is inexpensive to produce and maintain, and can be immediately used without the need for special skills.

Other objects of this invention will become apparent as the following specification progresses, reference being had to the accompanying drawing for an illustration of the invention.

IN THE DRAWING:

FIG. 1 is a side elevational view of the apparatus of the present invention;

FIG. 2 is a top plan view of the apparatus;

FIG. 3 is an end elevational view looking in the direction of line 3—3 of FIG. 2; and FIG. 4 is an enlarged, cross-sectional view taken along line 4—4 of FIG. 1.

The hand holding and supporting apparatus of the present invention is broadly denoted by the numeral 10 and includes a support in the form of a flat base plate 12 adapted to rest on the top of an operating table or other surface. A second, flat plate 14 is mounted on and in spaced relationship above plate 12 by an adjustable ball and socket assembly 16 which is lever-operated and allows tilting of upper plate 14 into a number of different operative positions with respect to lower plate 12.

The upper surface of plate 14 is flat to allow the back of the hand to be supported on plate 14 for working on the palmar surface of a patient's hand.

Assembly 16 includes a ball 18 secured to the lower end of a stub shaft 20 having its upper end secured in any suitable manner to a pair of rigid, plate-like elements 22 and 24, element 24 being secured in any suitable manner to the underside of plate 14.

Ball 18 is received within a tubular housing 26 having a neck opening 28 for shiftably receiving shaft 20. Housing 26 has a socket 30 near the upper end thereof for complementally engaging the upper part of ball 18.

The lower, sleeve-like portion **26*b* of housing 26 is threadably mounted on an externally threaded member 32 having a concave recess 34 at the upper thereof, recess 34 serving to shiftably receive and support ball 18. Member 32 is carried by a shaft 36 on a pedestal 38 secured in any suitable manner to lower plate 12**.

A lever 40 is rigidly secured to housing 26 and extends laterally therefrom. Lever 40 is provided to permit manual rotation of housing 26 on member 32. By rotating housing 26 in one direction, housing 26 is caused to move upwardly with respect to member 32 and thereby loosen ball 18 and allow pivoting movement of plate 14 relative to plate 12. Rotation of housing 26 in the opposite direction causes socket 30 to urge ball 18 into frictional engagement with the member 32 in recess 34, thereby releasably locking the ball and plate 14 in fixed positions with respect to plate 12.

Apparatus 10 further includes a semi-cylindrical device 42 pivotally mounted by a pair of hinges 44 to a second device which, for purposes of illustration, is a semi-cylindrical device 46. Device 46 is rigidly secured in any suitable manner to plate 14 at the adjacent end edge thereof, and a pair of spaced hinges 44 allow device 42 to move relative to device 46 from the full line position to the dashed line position of FIG. 1 and return. Both devices 42 and 46 have mating, flat surfaces **42*a* and 46*a* (FIG. 1) which are coextensive or coplanar with the upper surface of plate 14 when device 42 is in the dashed line position of FIG. 1**.

In the full line position of FIG. 1, device 42 provides a "hump" or cylindrical projection over which the fingers of hand of the patient can rest while a surgeon is operating on the back or dorsal surface of the wrist and/or the hand. The curved or convex outer surface of device 42 is ideal to support the hand because the fingers can curl over the outer surface of device 42.

Device 42 is shown in FIG. 2 as having a plurality of holes drilled thereinto. The purpose of the holes is to increase the surface area of device 42 such that retained heat caused by placing apparatus 10 in a steam autoclave can be quickly dissipated to allow the device to be used almost immediately after removal from the autoclave.

Another feature of device 42 is the provision of recesses 48 formed in the ends of device 42. These are provided to accept a patient's thumb, one of the recesses 48 being for the right thumb and the other recess being for the left thumb.

A pair of spaced, parallel bars 50 are secured at first ends thereof to a pair of depending, rigid legs 52 (FIGS. 1 and 4), legs 52 being secured at the upper ends to the underside of plate 14 in any suitable manner. Bars 50 extend laterally from legs 52 and are used to support device 42 when the latter is in its dashed line position of FIG. 1. Bars 50 avoid any stress build-up on hinges 44.

In use, apparatus 10 is placed in an operative position with plate 12 being supported on an operating table. Plate 14 is then pivoted with respect to plate 12 until the plate 14 is in a desired position. This is permitted by virtue of the manual manipulation of lever 40 which allows housing 26 to be rotated in a direction to loosen ball 18 in socket 30 and recess 34. By rotating lever 40 in the opposite direction, the ball is releasably gripped and fixed relative to housing 26.

When the palmar surface of the patient's hand is to be exposed, the dorsal surface of the hand rests on plate 14 and device 42 will typically be in the dashed line position of FIG. 1. This provides a maximum amount of surface for supporting the hand.

If the dorsal surface of the hand or the wrist of the patient is to be exposed, device 42 will generally be in the full line position of FIG. 1 so that the fingers of the hand can curve about the upper surface of device 42. In such a case, the thumb will rest in one or the other of the recesses 48. In actual use, the upper surface of plate 14 typically is covered with a sterile towel to pad the upper surface of plate 14.

What is claimed is:

1. Apparatus for holding and supporting a patient's hand for surgery comprising:

a support adapted to be placed on a surface;

a plate above the support;

means pivotally mounting the plate on the support in any one of a number of operative positions with respect thereto, said pivot means having means for releasably holding the plate in a fixed operative position;

a first device secured to and extending laterally from one end edge of the plate, said first device having an outer end edge; and a second device hingedly coupled to the outer end edge of the first device and movable from a first position extending outwardly from the first device to a second position overlying the first device, the devices having flat surfaces substantially flush with and aligned with the upper surface of the plate when the second device is in its first position, said devices providing additional upper surface area for the plate when the second device is in said first position to allow exposure of the palmar surface of a patient's hand, said second device having means for supporting the fingers of a patient's hand in a curved condition when the second device is in said second position to allow exposure of the dorsal surface of the patient's hand.

2. Apparatus as set forth in claim 1, wherein is included bar means carried by the plate for supporting the second device when the latter is in its first position.

3. Apparatus as set forth in claim 1, wherein the second device has a convex surface extending upwardly from the plane of the upper surface of the plate when the second device is in its second position overlying the first device.

4. Apparatus as set forth in claim 3, wherein said second device is semi-cylindrical in shape.

5. Apparatus as set forth in claim 3, wherein said second device is solid throughout its extent, the second device having a plurality of holes drilled into the convex surface area to increase the surface area for rapidly dissipating heat.

6. Apparatus as set forth in claim 3, wherein the second device has a thumb-receiving recess at each end thereof, respectively.

7. Apparatus for holding and supporting a patient's hand for surgery comprising:

a support adapted to be placed on a surface;

a plate above the support and having an upper surface;

means pivotally mounting the plate on the support in any one of a number of operative positions with respect thereto, said pivot means having means for releasably holding the plate in a fixed operative position; and means shiftably coupled with the plate for providing additional upper surface area for the plate when the palmar surface of a patient's hand is to be exposed and supported on the plate, said providing means having means movable relative to the plate into a position to present a finger support for supporting the fingers of a patient's hand in a curved condition when the dorsal surface of the patient's hand and the wrist are to be exposed and supported on the plate.

8. Apparatus as set forth in claim 7, wherein said pivot means comprises an adjustable ball and socket assembly.

9. Apparatus as set forth in claim 8, wherein said assembly includes a ball secured to the underside of the plate, and a member having a recess pivotally receiving the ball, and sleeve means carried by the ball and threadably coupled to the member for releasably securing the ball to the member.

10. Apparatus as set forth in claim 9, wherein is included a lever secured to and extending laterally from the sleeve member to permit manual rotation of the sleeve means relative to the socket member.

* * * * *